US009284677B2

(12) United States Patent
Kwon et al.

(10) Patent No.: US 9,284,677 B2
(45) Date of Patent: Mar. 15, 2016

(54) LAUNDRY MACHINE

(75) Inventors: Ig Geun Kwon, Changwon-si (KR); Soo Bong Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1082 days.

(21) Appl. No.: 13/259,754

(22) PCT Filed: May 27, 2010

(86) PCT No.: PCT/KR2010/003378

§ 371 (c)(1),
(2), (4) Date: Sep. 23, 2011

(87) PCT Pub. No.: WO2010/137894

PCT Pub. Date: Dec. 2, 2010

(65) Prior Publication Data

US 2012/0017655 A1 Jan. 26, 2012

(30) Foreign Application Priority Data

May 28, 2009 (KR) ..... 10-2009-0047192
Aug. 27, 2009 (KR) ..... 10-2009-0079909
May 18, 2010 (KR) ..... 10-2010-0046459
May 18, 2010 (KR) ..... 10-2010-0046461

(51) Int. Cl.

*D06F 23/06* (2006.01)
*D06F 37/26* (2006.01)
*D06F 25/00* (2006.01)
*D06F 37/20* (2006.01)

(Continued)

(52) U.S. Cl.

CPC ..... *D06F 37/268* (2013.01); *D06F 23/06* (2013.01); *D06F 25/00* (2013.01); *D06F 37/20* (2013.01); *D06F 37/206* (2013.01); *D06F 37/22* (2013.01); *D06F 37/262* (2013.01); *D06F 37/263* (2013.01); *D06F 37/267* (2013.01); *D06F 37/269* (2013.01); *D06F 39/12* (2013.01)

(58) Field of Classification Search

CPC ..... D06F 23/06
See application file for complete search history.

(56) References Cited

U.S. PATENT DOCUMENTS 1,593,678 A 7/1926 Statler
2,856,699 A 10/1958 Frey (Continued)

FOREIGN PATENT DOCUMENTS

CN 1179489 A 4/1998
CN 1208787 A 2/1999

(Continued)

OTHER PUBLICATIONS

ABT-MAH2400WH.pdf, web page posed on www.abt.com on Mar. 2009; Maytag MAH2400AWW 24 Compact Front-Load Washer; https://web.archive.org/web/20090301015816/http://www.abt.com/product/17027/Maytag-MAH2400AWW.html; posted on Mar. 19, 2015.

(Continued)

*Primary Examiner* — Jason Ko
(74) *Attorney, Agent, or Firm* — Ked & Associates, LLP

(57) ABSTRACT

A laundry machine is provided that includes a tub that holds washing water, a drum rotatably mounted in the tub, a drive having a rotational shaft connected to the drum, a bearing housing that rotatably supports the rotational shaft, a motor that rotates the rotational shaft, and a suspension assembly that supportably buffers vibration of the drum. An up/down direction height of a front of the tub is greater than a left/right direction width of the tub.

24 Claims, 7 Drawing Sheets

(51) Int. Cl.

| | |
|---|---|
| ***D06F 37/22*** | (2006.01) |
| ***D06F 39/12*** | (2006.01) |

(56) References Cited

U.S. PATENT DOCUMENTS

| | | | | |
|---|---|---|---|---|
| 3,275,152 | A | 9/1966 | Searle | 210/64 |
| 3,387,310 | A | 6/1968 | Marshall | 8/158 |
| 3,509,742 | A | 5/1970 | Fritz | 68/23.1 |
| 4,033,047 | A | 7/1977 | Kawai | 34/82 |
| 4,204,339 | A | 5/1980 | Muller | 34/75 |
| 4,891,892 | A | 1/1990 | Narang | 34/86 |
| 4,899,462 | A | 2/1990 | Putnam et al. | 34/19 |
| 5,231,805 | A | 8/1993 | Sander | 51/429 |
| 5,259,218 | A | 11/1993 | Broadbent | 68/12.06 |
| 5,582,040 | A | 12/1996 | Khan | 68/23.2 |
| 5,711,170 | A | 1/1998 | Johnson | 68/3 |
| 5,735,006 | A | 4/1998 | Vande Haar | 8/158 |
| 6,256,823 | B1 | 7/2001 | Kronbetter et al. | 8/158 |
| 6,557,383 | B1 | 5/2003 | Ito et al. | 68/23.2 |
| 6,941,680 | B1 | 9/2005 | Zielewicz et al. | |
| 7,020,985 | B2 | 4/2006 | Casey et al. | |
| 7,020,986 | B1 | 4/2006 | Nakai et al. | |
| 7,168,274 | B2 | 1/2007 | Slutsky et al. | |
| 7,251,963 | B2 | 8/2007 | Kim et al. | 68/196 |
| 7,398,662 | B2 | 7/2008 | Kim et al. | 68/23 |
| 7,458,171 | B1 | 12/2008 | Lentz | |
| 8,028,439 | B2 | 10/2011 | Prajescu | |
| 8,201,345 | B2 | 6/2012 | Dalton et al. | |
| 8,256,137 | B2 | 9/2012 | Noviello et al. | |
| 8,438,750 | B2 | 5/2013 | Dittmer et al. | |
| 8,468,711 | B2 | 6/2013 | Kim et al. | |
| 8,490,294 | B2 | 7/2013 | Brunert | |
| 8,607,473 | B2 | 12/2013 | Choi et al. | |
| 8,615,895 | B2 | 12/2013 | Shin et al. | |
| 8,627,580 | B2 | 1/2014 | Kim et al. | |
| 8,627,581 | B2 | 1/2014 | Brown | |
| 8,661,707 | B2 | 3/2014 | Dittmer et al. | |
| 8,667,705 | B2 | 3/2014 | Shin et al. | |
| 8,800,165 | B2 | 8/2014 | Kwon et al. | |
| 8,863,401 | B2 | 10/2014 | Grunert et al. | |
| 8,984,767 | B2 | 3/2015 | Grunert et al. | |
| 8,997,377 | B2 | 4/2015 | Kim et al. | |
| 9,027,256 | B2 | 5/2015 | Kim et al. | |
| 2004/0107742 | A1 | 6/2004 | Kim et al. | 68/24 |
| 2004/0123631 | A1 | 7/2004 | Chang | |
| 2004/0148978 | A1 | 8/2004 | Kim et al. | 68/23 |
| 2004/0163426 | A1 | 8/2004 | Kim et al. | 68/23 |
| 2004/0221474 | A1 | 11/2004 | Slutsky et al. | 34/319 |
| 2004/0226321 | A1 | 11/2004 | Park et al. | 68/23.1 |
| 2004/0261469 | A1 | 12/2004 | Park et al. | 68/23 |
| 2005/0120715 | A1 | 6/2005 | Labrador | |
| 2005/0183472 | A1 | 8/2005 | Choi | 68/23.1 |
| 2005/0262879 | A1 | 12/2005 | Kim et al. | 68/3 |
| 2005/0274159 | A1 | 12/2005 | Jeon et al. | 68/23.1 |
| 2006/0010935 | A1 | 1/2006 | Park et al. | 68/3 |
| 2006/0016228 | A1 | 1/2006 | Chang et al. | 68/23.1 |
| 2006/0053838 | A1 | 3/2006 | Inuzuka et al. | 68/3 |
| 2006/0075791 | A1 | 4/2006 | Seo et al. | 68/23.1 |
| 2006/0101865 | A1 | 5/2006 | Jeon et al. | 68/3 |
| 2006/0169006 | A1 | 8/2006 | Lim et al. | 68/13 |
| 2006/0174663 | A1 | 8/2006 | Cimetta et al. | 68/3 |
| 2006/0174665 | A1 | 8/2006 | Namkung et al. | 68/140 |
| 2007/0051142 | A1 | 3/2007 | Lim et al. | 68/139 |
| 2007/0074543 | A1 | 4/2007 | Lim et al. | 68/140 |
| 2007/0227200 | A1 | 10/2007 | Kim et al. | 68/140 |
| 2007/0289339 | A1 | 12/2007 | Lim | 68/23.1 |
| 2008/0099052 | A1 | 5/2008 | Lee et al. | 134/18 |
| 2008/0264114 | A1 | 10/2008 | Jang et al. | 68/139 |
| 2008/0276656 | A1 | 11/2008 | Kitamura et al. | |
| 2008/0307833 | A1 | 12/2008 | Chang et al. | 68/23.1 |
| 2009/0056389 | A1* | 3/2009 | Pinkowski et al. | 68/5 C |
| 2009/0178442 | A1 | 7/2009 | Kawabata et al. | |
| 2009/0178445 | A1 | 7/2009 | Brinkmann | 68/23 |
| 2010/0306928 | A1 | 12/2010 | Kimm et al. | |
| 2011/0173834 | A1 | 7/2011 | Arrigoni et al. | 34/90 |
| 2012/0000087 | A1 | 1/2012 | Da Riol et al. | |
| 2012/0090189 | A1 | 4/2012 | Kwon et al. | |
| 2013/0091726 | A1 | 4/2013 | Kim et al. | |
| 2013/0139402 | A1 | 6/2013 | Hong | 34/427 |
| 2013/0205840 | A1 | 8/2013 | Hong et al. | |
| 2013/0219734 | A1 | 8/2013 | Kim et al. | |
| 2013/0255099 | A1 | 10/2013 | Cavarretta et al. | 34/108 |
| 2013/0263630 | A1 | 10/2013 | Doh et al. | |
| 2013/0291395 | A1 | 11/2013 | Doh et al. | |
| 2013/0318813 | A1 | 12/2013 | Hong et al. | |
| 2014/0150277 | A1 | 6/2014 | Kwon et al. | |
| 2014/0150279 | A1 | 6/2014 | Kwon et al. | |
| 2014/0208609 | A1 | 7/2014 | Han et al. | |

FOREIGN PATENT DOCUMENTS

| | | | |
|---|---|---|---|
| CN | 1508349 | A | 6/2004 |
| CN | 1511996 | A | 7/2004 |
| CN | 1540085 | A | 10/2004 |
| CN | 1548627 | A | 11/2004 |
| CN | 1707010 | A | 12/2005 |
| CN | 1724742 | A | 1/2006 |
| CN | 1730776 | A | 2/2006 |
| CN | 1730777 | A | 2/2006 |
| CN | 1730778 | A | 2/2006 |
| CN | 1814895 | A | 8/2006 |
| CN | 1844543 | A | 10/2006 |
| CN | 1906351 | A | 1/2007 |
| CN | 1940166 | A | 4/2007 |
| CN | 101046046 | A | 10/2007 |
| CN | 101173482 | | 5/2008 |
| CN | 101343826 | | 1/2009 |
| CN | 101381946 | A | 3/2009 |
| CN | 100513673 | | 7/2009 |
| DE | 25 03 576 | A1 | 8/1976 |
| DE | 3438575 | A1 | 4/1986 |
| DE | 41 04 450 | A1 | 8/1992 |
| DE | 44 13 069 | A1 | 10/1994 |
| DE | 297 16 968 | U1 | 11/1997 |
| DE | 198 56 973 | A1 | 6/1999 |
| DE | 103 42 254 | B3 | 11/2004 |
| DE | 10 2006 012 035 | B3 | 3/2007 |
| DE | 10 2006 031 352 | A | 1/2008 |
| EP | 0 152 745 | A2 | 8/1985 |
| EP | 0 443 361 | A1 | 8/1991 |
| EP | 0 648 885 | A1 | 4/1995 |
| EP | 1 079 014 | A1 | 2/2001 |
| EP | 1 270 791 | A2 | 1/2003 |
| EP | 1 433 890 | A2 | 6/2004 |
| EP | 1 445 368 | A2 | 8/2004 |
| EP | 1 529 869 | A2 | 5/2005 |
| EP | 1 605 088 | A2 | 12/2005 |
| EP | 1 619 286 | A2 | 1/2006 |
| EP | 1 688 524 | A1 | 8/2006 |
| EP | 1 688 525 | A1 | 8/2006 |
| EP | 1 688 531 | A1 | 8/2006 |
| EP | 1 690 969 | A1 | 8/2006 |
| EP | 1 710 340 | A2 | 10/2006 |
| EP | 1 722 025 | A1 | 11/2006 |
| EP | 1 746 192 | A2 | 1/2007 |
| EP | 1 770 199 | A2 | 4/2007 |
| EP | 1 840 257 | A1 | 10/2007 |
| EP | 1 857 583 | A1 | 11/2007 |
| EP | 1 881 099 | A1 | 1/2008 |
| EP | 1 975 298 | A1 | 10/2008 |
| EP | 2 039 819 | A1 | 3/2009 |
| EP | 2 053 157 | A1 | 4/2009 |
| EP | 2 075 364 | A1 | 7/2009 |
| EP | 2 078 777 | A1 | 7/2009 |
| EP | 2 390 401 | A2 | 11/2011 |
| EP | 2 435 624 | A2 | 4/2012 |
| FR | 2 931 489 | A1 | 11/2009 |
| GB | 913801 | A | 12/1962 |
| GB | 1181797 | A | 2/1970 |
| GB | 2 091 123 | A | 7/1982 |
| GB | 2 279 968 | A | 1/1995 |
| JP | S52-131661 | A | 11/1977 |
| JP | H07-275591 | A | 10/1995 |
| JP | H10-211393 | A | 8/1998 |

(56) References Cited

FOREIGN PATENT DOCUMENTS

| | | | |
|---|---|---|---|
| JP | 3502039 | B2 | 3/2004 |
| JP | 2006-061613 | A | 3/2006 |
| JP | 2008-006045 | A | 1/2008 |
| JP | 2008-259665 | A | 10/2008 |
| JP | 2009-028400 | A | 2/2009 |
| JP | 2009-060990 | A | 3/2009 |
| JP | 2009-61217 | | 3/2009 |
| KR | 10-2003-0092185 | A | 12/2003 |
| KR | 10-2005-0108609 | A | 11/2005 |
| KR | 10-2006-0095816 | A | 9/2006 |
| KR | 10-2007-0059431 | A | 6/2007 |
| KR | 10-2007-0101732 | A | 10/2007 |
| KR | 10-2008-0002475 | A | 1/2008 |
| KR | 10-0808192 | B1 | 2/2008 |
| KR | 10-2008-0072187 | A | 8/2008 |
| RU | 2 085 641 | C1 | 7/1997 |
| RU | 2 182 197 | C2 | 5/2002 |
| RU | 2 303 092 | C1 | 7/2007 |
| RU | 2 303 668 | C2 | 7/2007 |
| WO | WO 01/96647 | A1 | 12/2001 |
| WO | WO 2005/017249 | A1 | 2/2005 |
| WO | WO 2007/105843 | A1 | 9/2007 |
| WO | WO 2008/003592 | A1 | 1/2008 |
| WO | WO 2008/007888 | A2 | 1/2008 |
| WO | WO 2008/103007 | A2 | 8/2008 |
| WO | WO 2009/040302 | | 4/2009 |
| WO | WO 2009/040302 | A1 | 4/2009 |
| WO | WO 2009/050095 | A1 | 4/2009 |
| WO | WO 2009/148251 | A2 | 12/2009 |

OTHER PUBLICATIONS

Amazon-MAH2400AWW.pdf, web page posted on www.amazon.com on Mar. 2005; Maytag MAH2400AWW 24 Compact Front-Load Washer 2.1 cu. Ft. Capacity—White; http:/www.amazon.com/Maytag-MAH2400AWW/Compact-Front-Load-Capacity/dp/8000UVYEOM/ref=cm_cm_cd_ql_qh_dp_t; posted on Mar. 19, 2015.

Maytag-MAH2400AWW.pdf, web page posted on www.maytag.com on May 2005; Maytag Compact Washer—model MAH2400A; https://web.archive.org/web/2005052164236/http://www.maytag.com/mths/products/product.jsp?model=MAH2400AWWW; posted on Mar. 19, 2015.

United States Office Action dated Feb. 5, 2015 issued in U.S. Appl. No. 13/319,167.

United States Final Office Action dated Mar. 16, 2015 issued in U.S. Appl. No. 13/143,032.

United States Final Office Action dated Mar. 24, 2015 issued in U.S. Appl. No. 13/259,016.

United States Office Action dated Mar. 26, 2015 issued in U.S. Appl. No. 13/318,549.

United States Final Office Action dated Apr. 9, 2015 issued in U.S. Appl. No. 13/320,697.

ABT-MAH2400WH.pdf, web page posted on www.abt.com on Mar. 2009; https://web.archive.org/web/20090301015816/http://www.abt.com/_product/17027/Maytag-MAH2400AWW.html; retrieved by Examiner on Mar. 19, 2015.

Maytag-MAH2400AWW.pdf, web page posted on www.maytag.com on May 2005; https://web.archive.org/web/20050502164236/http://www.maytag.com/mths/products/product.jsp?model=MAH2400AWWW; retrieved by Examiner on Mar. 19, 2015.

Amazon-MAH2400AWW.pdf, web page posted on www.amazon.com on Mar. 2015; http:/www.amazon.com/Maytag-MAH2400AWWCompact-Front-Load-Capacity/dp/8000UVYEOM/ref=cm_cd_ql_qh_dp_t; retrieved by Examiner on Mar. 19, 2015.

European Search Report dated Feb. 25, 2014 issued in Application No. 10 78 0803.2.

European Search Report dated Feb. 25, 2014 issued in Application No. 10 78 0805.7.

European Search Report dated Feb. 26, 2014 issued in Application No. 10 78 0804.0.

European Search Report dated Feb. 26, 2014 issued in Application No. 10 78 0806.5.

European Notice of Allowance dated Feb. 28, 2014 issued in Application No. 10 78 0823.0.

European Search Report dated Mar. 19, 2014 issued in Application No. 13 19 8677.0.

United States Office Action dated Apr. 11, 2014 issued in U.S. Appl. No. 13/320,697.

Chinese Office Action dated Mar. 5, 2013 issued in Application No. 201080017293.4 (with English translation).

Chinese Office Action dated Mar. 28, 2013 issued in Application No. 201080021257.5 with English translation).

Russian Decision to Grant a Patent dated May 15, 2014 issued in Application No. 2011147481 (with English translation).

United States Office Action dated Jun. 12, 2014 issued in U.S. Appl. No. 13/318,655.

United States Office Action dated Jun. 17, 2014 issued in U.S. Appl. No. 13/258,965.

Chinese Office Action dated Jun. 4, 2013 issued in Application No. 201080021259.4 (with English translation).

Chinese Office Action dated Jun. 4, 2013 issued in Application No. 201080022490.5 (with English translation).

International Search Report issued in PCT Application No. PCT/KR2010/003378 dated Apr. 6, 2011.

International Search Report and Written Opinion dated Sep. 14, 2010 issued in Application No. PCT/KR2009/007869.

International Search Report and Written Opinion dated Oct. 27, 2010 issued in Application No. PCT/KR2010/003379.

International Search Report and Written Opinion dated Oct. 27, 2010 issued in Application No. PCT/KR2010/003400.

International Search Report and Written Opinion dated Nov. 24, 2010 issued in Application No. PCT/KR2010/003376.

International Search Report and Written Opinion dated Nov. 24, 2010 issued in Application No. PCT/KR2010/003377.

International Search Report and Written Opinion dated Nov. 24, 2010 issued in Application No. PCT/KR2010/003378.

International Search Report and Written Opinion dated Nov. 29, 2010 issued in Application No. PCT/KR2010/003404.

International Search Report and Written Opinion dated Nov. 29, 2010 issued in Application No. PCT/KR2010/003405.

International Search Report and Written Opinion dated Nov. 29, 2010 issued in Application No. PCT/KR2010/003409.

International Search Report and Written Opinion dated Nov. 29, 2010 issued in Application No. PCT/KR2010/003410.

International Search Report and Written Opinion dated Jan. 21, 2011 issued in Application No. PCT/KR2010/003406.

International Search Report and Written Opinion dated Jan. 31, 2011 issued in Application No. PCT/KR2010/003408.

International Search Report and Written Opinion dated Jul. 19, 2011 issued in Application No. PCT/KR2009/007963.

International Search Report and Written Opinion dated Sep. 21, 2011 issued in Application No. PCT/KR2009/007960.

European Search Report dated Jul. 31, 2012 issued in Application No. 09 83 6377.

United States Office Action dated Aug. 4, 2014 issued in U.S. Appl. No. 13/318,655.

United States Office Action dated Sep. 3, 2014 issued in U.S. Appl. No. 13/142,620.

United States Office Action dated Sep. 9, 2014 issued in U.S. Appl. No. 13/259,709.

United States Office Action dated Oct. 2, 2014 issued in U.S. Appl. No. 13/259,832.

United States Office Action dated Nov. 14, 2013 issued in U.S. Appl. No. 13/266,838.

Russian Decision to Grant a Patent dated Aug. 29, 2014 issued in Application No. 2011146320/12 (with English translation).

Russian Decision to Grant a Patent dated Aug. 29, 2014 issued in Application No. 2011147482/12 (with English translation).

United States Office Action dated Nov. 6, 2014 issued in U.S. Appl. No. 13/142,986.

(56) References Cited

OTHER PUBLICATIONS

United States Office Action dated Nov. 18, 2014 issued in U.S. Appl. No. 13/143,032.
United States Office Action dated Nov. 20, 2014 issued in U.S. Appl. No. 13/259,016.
European Search Report dated Oct. 19, 2012 issued in Application No. 10 78 0817.
European Search Report dated Oct. 22, 2012 issued in Application No. 10 78 0819.
European Search Report dated Oct. 24, 2012 issued in Application No. 10 78 0823.
European Search Report dated Oct. 26, 2012 issued in Application No. 10 78 0820.
European Office Action dated Jan. 2, 2014 issued in Application No. 10 780 822.2.
Russian Office Action dated Jan. 22, 2014 issued in Application No. 2011132074 (with English translation.).
Russian Office Action dated Jan. 30, 2014 issued in Application No. 2011147481 (with English translation).
European Office Action dated Feb. 5, 2014 issued in Application No. 10 780 817.2.
United States Office Action dated Dec. 29, 2014 issued in U.S. Appl. No. 13/266,895.
United States Final Office Action dated Jan. 9, 2015 issued in U.S. Appl. No. 13/318,655.
United States Final Office Action dated Jan. 21, 2015 issued in U.S. Appl. No. 13/142,620.
Chinese Office Action dated Dec. 25, 2012 issued in Application No. 200980155851.0 with English translation).
Chinese Office Action dated Dec. 28, 2012 issued in Application No. 200980155608.9 (with English translation).
U.S. Final Office Action issued in U.S. Appl. No. 13/319,167 dated May 18, 2015.
U.S. Office Action issued in U.S. Appl. No. 13/143,032 dated Jun. 29, 2015.
U.S. Office Action issued in U.S. Appl. No. 13/318,655 dated Jun. 30, 2015.
U.S. Notice of Allowance issued in U.S. Appl. No. 14/173,892 dated Jul. 27, 2015.
U.S. Notice of Allowance issued in U.S. Appl. No. 14/173,948 dated Jul. 27, 2015.
U.S. Notice of Allowance issued in U.S. Appl. No. 14/173,908 dated Jul. 28, 2015.
U.S. Office Action issued in U.S. Appl. No. 14/173,928 dated Jul. 30, 2015.
U.S. Office Action issued in U.S. Appl. No. 13/142,620 dated Aug. 3, 2015.
U.S. Office Action issued in co-pending U.S. Appl. No. 13/320,697 dated Sep. 3, 2015.
Chinese Office Action issued in Application No. 201410148938.8 dated Aug. 21, 2015.
Chinese Office Action issued in Application No. 201410149092.X dated Aug. 21, 2015.
Chinese Office Action issued in Application No. 201410148940.5 dated Aug. 25, 2015.
Chinese Office Action issued in Application No. 201410148311.2 dated Sep. 2, 2015.
European Office Action issued in Application No. 13 198 681.2 dated Oct. 8, 2015.
Final Office Action issued in co-pending U.S. Appl. No. 13/142,620 dated Nov. 16, 2015.
Final Office Action issued in a co-pending U.S. Appl. No. 13/259,016 dated Jan. 4, 2016.

* cited by examiner

LAUNDRY MACHINE

TECHNICAL FIELD

The present invention relates to laundry machines, and more particularly, to a laundry machine of which structure is improved for increasing a washing capacity.

BACKGROUND ART

In general, the laundry machine removes various kinds of contaminants from clothes and beddings by using a softening action of detergent, friction of water flow and impacts applied to laundry caused by rotation of a pulsator or a drum. Current full automatic laundry machine carries out a series of courses of washing, rinsing, spinning, and so on automatically without intermittent handling of a user.

It is a current trend that demands for the drum type washing machine increase gradually, which, not only enables to reduce a total height, but also does not cause problems of entangling and crumpling of the laundry compared to a pulsator type laundry machine in which a washing tub rotates in an upright position.

A structure of the drum type washing machine will be described briefly. The drum type washing machine is provided with a body cabinet which forms an exterior of the drum type washing machine, a tub in the body cabinet supported by dampers and springs for holding washing water, and a cylindrical drum in the tub for placing the laundry therein, wherein the drum has driving power applied thereto by a driving unit for washing the laundry placed therein.

The drum type washing machine inevitably causes vibration due to rotation force of the drum, eccentricity of the laundry, and the like at the time the drum rotates for washing or spinning the laundry introduced to the drum, and the vibration caused by the rotation of the drum is transmitted to an outside of the drum type washing machine through the tub and the cabinet.

Consequently, in order to prevent the vibration from transmitting to the cabinet from the drum through the tub, springs and dampers are provided between the tub and the cabinet for buffering and damping the vibration of the tub, without fail.

In the meantime, the drum type washing machine is mostly installed, not independently, but in conformity with an existing installation environment (for an example, a sink environment or a built-in environment). Therefore, it is required that a size of the drum type washing machine is limited to the installation environment.

Thus, because change of an inside structure of the drum type washing machine is limited by the spring and damper which are provided for damping the vibration between the tub and the cabinet, and the installation environment of the drum type washing machine is limited, change of the size of the drum type washing machine itself is limited.

In the meantime, currently, in order to increase an amount of washing and users convenience, many researches and developments are undergoing for increasing a washing capacity of the laundry machine. However, above limitations impose many difficulties on the increasing of the size of the tub for increasing the washing capacity in an existing drum type washing machine structure.

Consequently, a variety of structures of laundry machines are being developed for increasing the washing capacity.

DISCLOSURE OF INVENTION

Technical Problem

To solve the problems, an object of the present invention is to provide a drum type washing machine having a new structure completely different from the related art laundry machine, especially different-shaped tub.

Solution to Problem

To achieve these objects and other advantages and in accordance with the purpose of the invention, as embodied and broadly described herein, a laundry machine includes a tub for holding washing water, a drum rotatably mounted in the tub, a driving unit having a rotation shaft connected to the drum, a bearing housing for rotatably supporting the rotation shaft, and a motor for rotating the rotation shaft, and a suspension assembly for supportably buffering vibration of the drum, wherein the an up/down direction height of a front of the tub is greater than a left/right direction width of the tub.

In this instance, the front of the tub has a cross section formed by connecting two circles in a vertical direction, the two circles respectively having two centers spaced in a vertical direction.

Preferably, the front of the tub has a horizontal cut portion at a bottom of the tub, and further includes an enlarged space extended outward from the horizontal cut portion. Preferably, the horizontal cut portion is spaced from a front surface of the tub toward a rear side of the tub by a predetermined distance. Preferably, a distance from a center of the front of the tub to a center of a bottom of the front of the tub is shorter than a distance from the center of the front of the tub to the enlarged space tub.

Preferably, the tub has a laundry opening in the front of the tub for introduction of laundry, wherein the laundry opening has a center spaced from the center of the front of the tub. Preferably, the center of the laundry opening positioned over the center of the front of the tub. Preferably, the tub has an upper portion of the front formed by the laundry opening has a width smaller than a lower portion of the front formed by the laundry opening. Preferably, a sum of the upper portion of the front formed by the laundry opening and the lower portion of the front formed by the laundry opening is greater than a sum of the left portion of the front formed by the laundry opening and the right portion of the front formed by the laundry opening.

Preferably, the distance from the center of the front of the tub to the center of the bottom of the front of the tub is shorter than a side of the bottom of the tub. Preferably, the suspension assembly is connected to the bearing housing.

Preferably, the laundry machine further includes a rear gasket to make flexible connection of the tub to the driving unit for preventing washing water from leaking from the driving unit and the tub, and enabling the driving unit movable relative to the tub. Preferably, the tub has a rear surface formed on a rear side to have an opening having the rear gasket fastened thereto. Preferably, the rear surface of the tub has an upper width formed by the opening smaller than a lower width of the rear surface of the tub formed by the opening. Preferably, a sum of the upper width of the rear surface of the tub formed by the opening and the lower width of the rear surface of the tub formed by the opening is greater than a sum of the left width of the rear surface of the tub formed by the opening and the right width of the rear surface of the tub formed by the opening.

In another aspect of the present invention, a laundry machine includes a tub for holding washing water, a drum rotatably mounted in the tub, a driving unit having a rotation shaft connected to the drum, a bearing housing for rotatably supporting the rotation shaft, and a motor for rotating the rotation shaft, and a suspension assembly for supportably buffering vibration of the drum, wherein the tub has a front surface which forms a front of the tub, the front surface has a rim portion projected from the front surface, the rim portion have projections, and portions of the front surface in rear of the projections have a plurality of ribs formed in a direction the same with a projection direction of the projections.

In this instance, preferably, the front surface has a plurality of radial ribs formed on at least one portion other than the portions of the front surface in rear of the projections. Preferably, the plurality of radial ribs have distances between the radial ribs each greater than each of distances between the ribs at the portions of the front surface in rear of the projections. Preferably, the portion having the radial ribs formed thereon has circumferential direction ribs formed thereon, additionally. Preferably, the projections at the rim portion are at least one of a water supply inlet, a hot air inlet, a circulating water supply inlet, and a steam supply inlet.

In another aspect of the present invention, a laundry machine includes a tub for holding washing water, a drum rotatably mounted in the tub, a driving unit having a rotation shaft connected to the drum, a bearing housing for rotatably supporting the rotation shaft, and a motor for rotating the rotation shaft, and a suspension assembly for supportably buffering vibration of the drum, wherein the rear surface of the tub has ribs formed thereon with heights lower, or a number smaller, than the ribs formed on the front surface. In this instance, preferably, the rear surface is a smooth surface without ribs.

In another aspect of the present invention, a laundry machine includes a tub for holding washing water, a drum rotatably mounted in the tub, a driving unit having a rotation shaft connected to the drum, a bearing housing for rotatably supporting the rotation shaft, and a motor for rotating the rotation shaft, and a suspension assembly for supportably buffering vibration of the drum, wherein a rear surface has thickness including the ribs on the tub smaller than thickness of the front surface or the side surface including the ribs on the tub.

In the meantime, preferably, the suspension assembly is connected to the bearing housing. Preferably, the laundry machine further includes a rear gasket for sealing to prevent washing water from leaking from a space between the driving unit and the tub, and enabling the driving unit movable relative to the tub. Preferably, the tub is supported rigidly more than the drum being supported by the suspension assembly.

In the meantime, the washing machine can have the tub fixedly mounted thereto, or supported by a flexible supporting structure, like a suspension assembly. Or the washing machine can be supported to an extent intermediate between the supporting and the suspension and the fixed mounting.

That is, the tub can be supported fixedly to an extent similar to the suspension assembly to be described later, or rigidly more than supporting with the suspension. For an example, the tub can be supported by the suspension, or by ones, such as rubber bushings, for providing a certain extent of flexibility to the tub even though the supporting is not flexible more than the suspension.

More examples, in which the tub is supported rigidly more than the suspension assembly, are as follows;

First, at least a portion of the tub can be formed as one unit with the cabinet.

Second, the tub can be supported connected with screws, rivets, or rubber bushings, or supported secured with welding, adhesive sealing, or the like. In this case, those connections may have rigidity greater than the suspension assembly with respect to up/down directions which are major vibration directions of the drum.

The tub can have a shape enlarged within a space the tub is mounted therein as far as possible. That is, the tub can be enlarged close to a wall or a frame (for an example, left or right side plate of the cabinet) that limits a left/right direction size of the space at least in left/right directions (a direction perpendicular to an axis direction of a rotation shaft in a horizontal direction). The tub can be fabricated as one unit with the left or right side wall of the cabinet.

Relatively, the tub can be formed closer to the wall or the frame than the drum in the left/right directions. For an example, the tub can be formed to be spaced from the wall or the frame less than 1.5 time of a space to the drum. In a state the tub is enlarged in the left/right directions thus, the drum also can be enlarged in the left/right directions. The smaller the left/right direction spaces between the tub and the drum, the drum can be enlarged the more. In reducing the left/right direction spaces between the tub and the drum, left/right direction vibration of the drum can be taken into account. The smaller the left/right direction vibration of the drum, a diameter of the drum can become the greater. Therefore, the suspension assembly which attenuates the vibration of the drum can be made to have left/right direction rigidity greater than other direction rigidity. For an example, the suspension assembly can be made to have rigidity with respect to a left/right direction deformation the greatest compared to rigidity in other directions.

Different from the related art, the suspension assembly can be directly connected to the bearing housing which supports the rotation shaft connected to the drum, without passed through the tub. That is, the bearing housing can include a supporting portion for supporting the rotation shaft and an extension extended therefrom, and the suspension assembly can be fastened to the supporting portion or the extension of the bearing housing.

In this instance, the suspension assembly can include a bracket extended in an axis direction of the rotation shaft. And, the bracket can be extended forward toward the door.

In the meantime, the suspension assembly can include at least two suspensions spaced in an axis direction of the rotation shaft.

The suspension assembly can include a plurality of suspensions which are mounted under the rotation shaft for standably supporting an object of supporting (for an example, the drum). Or, the suspension assembly can include a plurality of suspensions which are mounted over the rotation shaft for suspendably supporting an object of supporting. Those cases are of types in which the suspensions are provided only under or over the rotation shaft for supporting.

A center of gravity of an oscillating body including the drum, the rotation shaft, the bearing housing, and the motor can be positioned on a side of the motor with reference to at least a length direction geometric center of the drum.

One of the suspensions can be positioned in front or rear of the center of gravity. Moreover, the suspensions can be mounted in front and rear of the center of gravity, respectively.

The tub can have a rear opening. A driving unit including the rotation shaft, the bearing housing, and the motor can be connected to the tub through a flexible member. The flexible member can be made to seal such that water does not leak through the rear opening of the tub, and to enable the driving unit to move relative to the tub. The flexible member can be fabricated such that the flexible member can seal leakage of the washing water through an opening in a rear side of the tub and the driving unit can make movement relative to the tub. The flexible member may be of any material as far as the material can function as a seal and is flexible. For an example, the flexible member may be formed of a gasket material like the front gasket. In this case, for conveniences sake, the flexible member may be called as a rear gasket with reference to the front gasket. The rear gasket can be connected to the driving unit in a state the rear gasket is limited not to rotate at least in a rotation direction of the rotation shaft. As an embodiment, the rear gasket can be connected to the rotation shaft directly, or to the extension of the bearing.

A portion of the driving unit positioned in front of a connection portion to the rear gasket so as to be vulnerable to exposure to the washing water in the tub can be made to be prevented from corrosion by the washing water. For an example, the portion may be coated, or a front surface thereof may be covered with an additional component (for an example, a tub back to be described late) of plastic. Parts of the driving unit formed of metal can be prevented from corrosion by preventing the parts from direct exposure to the water.

Along with this, different from the embodiment, the cabinet may not be included to the washing machine. For an example, in a case of a built-in washing machine, a space the washing machine is to be installed therein may be provided, not by the cabinet, but by a wall structure. That is, the washing machine can be fabricated in a shape with does not include the cabinet which forms an exterior, independently. However, in this case too, the front frame can be required for a front exterior.

Advantageous Effects of Invention

The laundry machine of the present invention has following advantageous effects.

A drum type washing machine having a completely different structure from a related art can be provided.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

In describing the present invention, names of elements are defined taking functions thereof into account. Therefore, it is required to understand that the names do not limit the elements technically. Moreover, the names of the elements may be called differently in this field of art.

Figure 1:
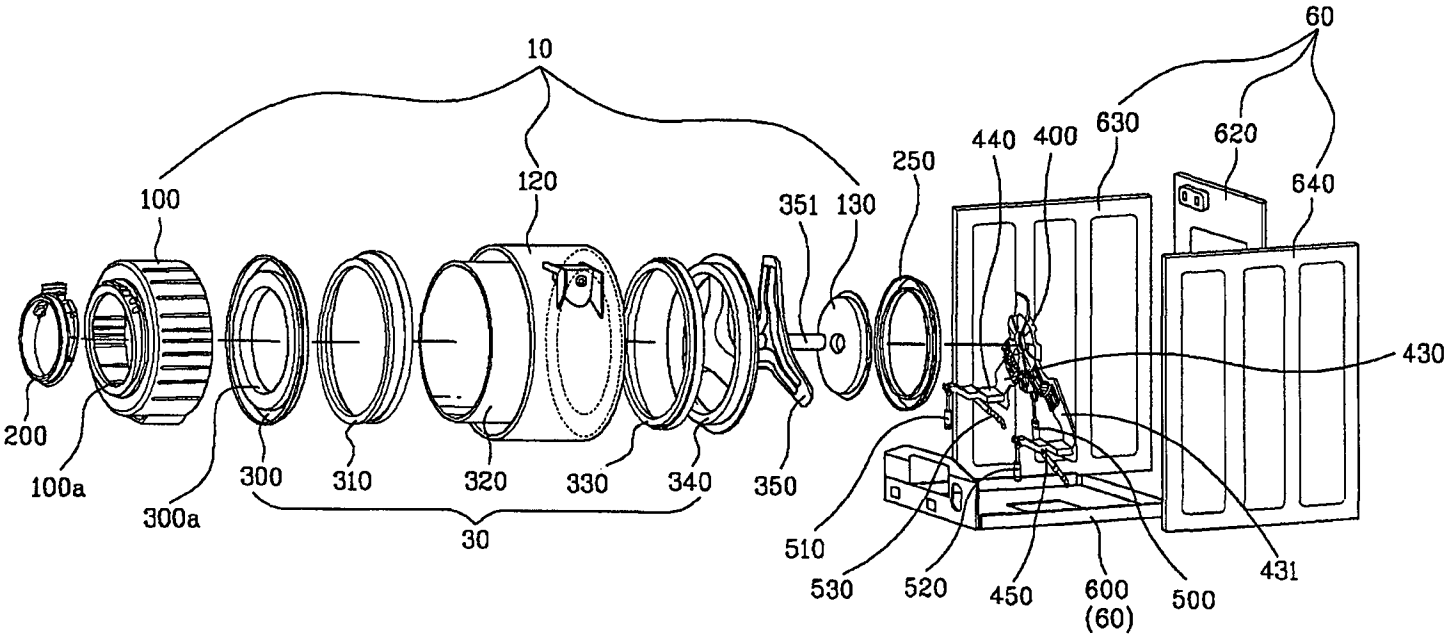
FIG. 1 illustrates an exploded perspective view of a laundry machine in accordance with a preferred embodiment of the present invention.

FIG. 1 illustrates an exploded perspective view of a laundry machine in accordance with a preferred embodiment of the present invention.

Referring to FIG. 1, the laundry machine has a tub 10 fixedly secured to a cabinet. The tub includes a tub front 100 which forms a front portion thereof and a tub rear 120 which forms a rear portion thereof. The tub front 100 and the tub rear 120 are fastened together with screws for forming a space for placing a drum therein. The tub also includes a tub back 130 which forms a rear surface thereof. The tub back 130 is connected to the tub rear 120 with a rear gasket 250. The rear gasket 250 is formed of a flexible material for preventing vibration from transmitting to the tub rear 120 from the tub back 130.

The cabinet 60 forms an exterior of the laundry machine. The cabinet 60 has a cabinet front (not shown), a cabinet rear 620, a cabinet left 640, a cabinet right 640, a cabinet right 630, a cabinet top (not shown), and a cabinet base 600.

The tub rear 120 has a rear surface 128. The rear surface 128 of the tub rear 120, the tub back 130, and the rear gasket 250 form a rear wall surface of the tub 10. The rear gasket 250 is sealably connected to the tub back 130 and the tub rear 120 respectively for preventing the washing water from leaking from the tub 10. The tub back 130 vibrates together with the drum 30 when the drum 30 rotates. In order to prevent the tub back 130 from interfering with the tub rear 120 at the time the tub back 130 vibrates, the tub back 130 is spaced from the tub rear 120, adequately. Since the rear gasket 250 is formed of a flexible material, the rear gasket 250 allows the tub back 130 to make relative motion without interference with the tub rear 120. The rear gasket 250 may have a corrugated portion 252 (See FIG. 4) which can be extended adequately for allowing the relative motion of the tub back 130.

A foreign matter getting in preventive member 200 is connected to a front of the tub front 100 for preventing foreign matters from entering between the tub 10 and the drum 30. The foreign matter getting in preventive member 200 is formed of a flexible material, and fixedly mounted to the tub front 100. The foreign matter getting in preventive member 200 may be formed of a material the same with the rear gasket 250.

The drum 30 includes a drum front 300, a drum center 320, and a drum back 340. The drum front 300 has a laundry opening for introducing the laundry to the drum 30. Ball balancers 310 and 330 are mounted to a front portion and a rear portion of the drum 30, respectively. The drum back 340 is connected to a spider 350, and the spider 350 is connected to a rotation shaft 351. The drum 30 rotates in the tub by rotation force transmitted thereto through the rotation shaft 351.

The rotation shaft 351 is passed through the tub back 130 and connected to the motor in a direct manner. More specifically, a rotor (not shown) of the motor and the rotation shaft 351 are connected, directly. There is a bearing housing 400 coupled to the rear surface 128 of the tub back 130. The bearing housing 400 rotatably supports the rotation shaft 351 between the motor and the tub back 130.

A stator is fixedly mounted to the bearing housing 400. The rotor is positioned around the stator. As described before, the rotor is directly connected to the rotation shaft 351. The motor, being an outer rotor type motor, is connected to the rotation shaft 351, directly.

Figure 5:
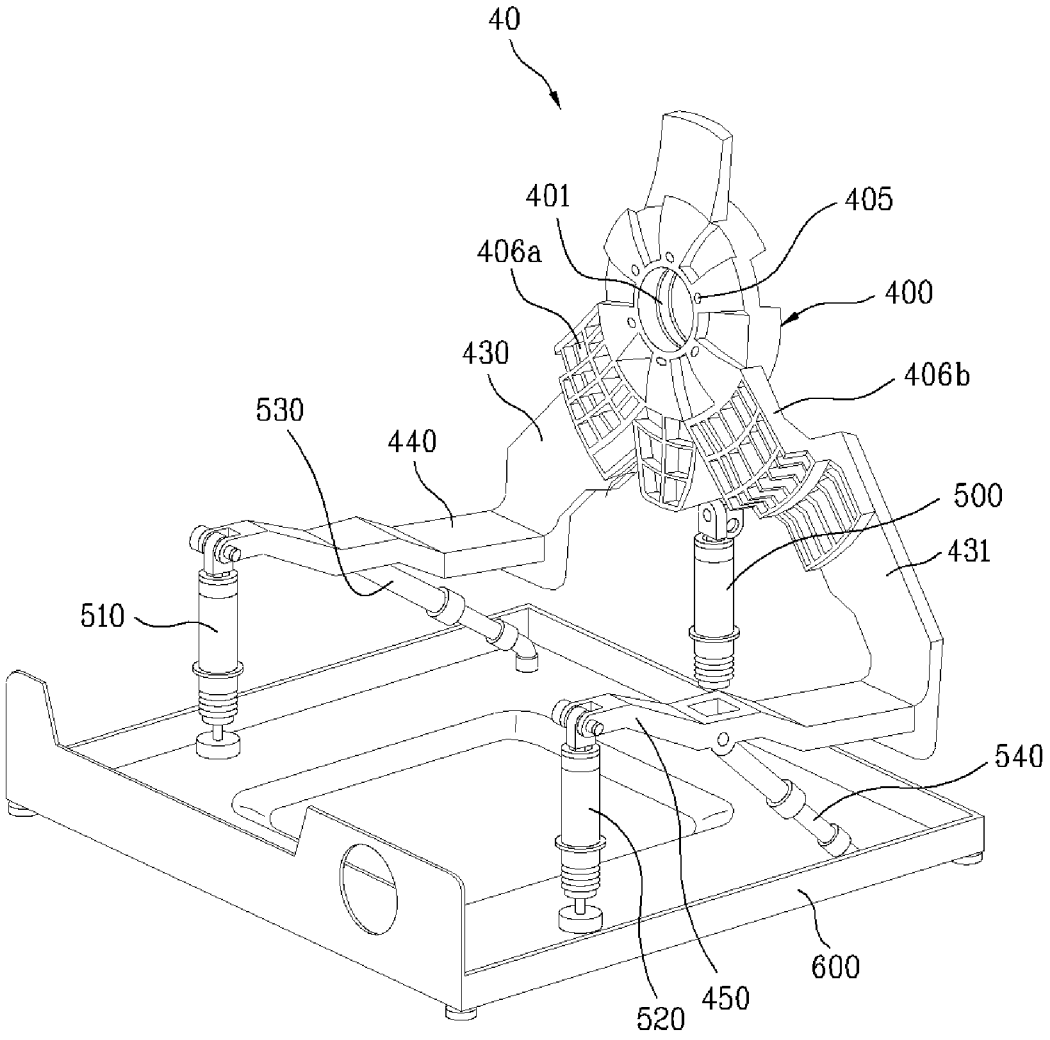
FIG. 5 illustrates a suspension of a laundry machine in accordance with a preferred embodiment of the present invention.

The bearing housing 400 is supported on a cabinet base 600 through a suspension assembly 40 (See FIG. 5). The suspension assembly 40 includes three spring cylinder dampers 500, 510 and 520 and two cylinder dampers 530 and 540 for supporting in front/rear directions in a tilted positions. The suspension assembly 40 is connected to the cabinet base 600, not fixedly perfectly, but to allow a certain extent of elastic deformation to allow the drum 30 to move in front/rear and left/right directions.

That is, the suspension assembly 40 is elastically supported to allow a certain extent of rotation of the suspension assembly 40 in front/rear and left/right directions with respect to a supporting point at which the suspension assembly 40 is connected to the base 600. In order to make such elastic supporting available, the vertical suspensions may be mounted to the base 600 with rubber bushings disposed therebetween, respectively. Of the suspensions, it can be configured that the vertical suspensions elastically buffer vibration of the drum, and the tilted suspensions dampens the vibration of the drum 30. That is, it can be configured that, of a vibration system having springs and damping means, ones mounted in vertical positions serve as springs and ones mounted in a tilted positions serve as damping means.

The tub 10 is fixedly mounted to the cabinet except the tub back 130, and the vibration of the drum 30 is buffered and supported by the suspension assembly 40. It can be said that supporting structures for the tub 10 and the drum 30 are separated from each other actually, such that the tub 10 does not vibrate even if the drum 30 vibrates.

Respective parts will be described in detail.

Figure 2:
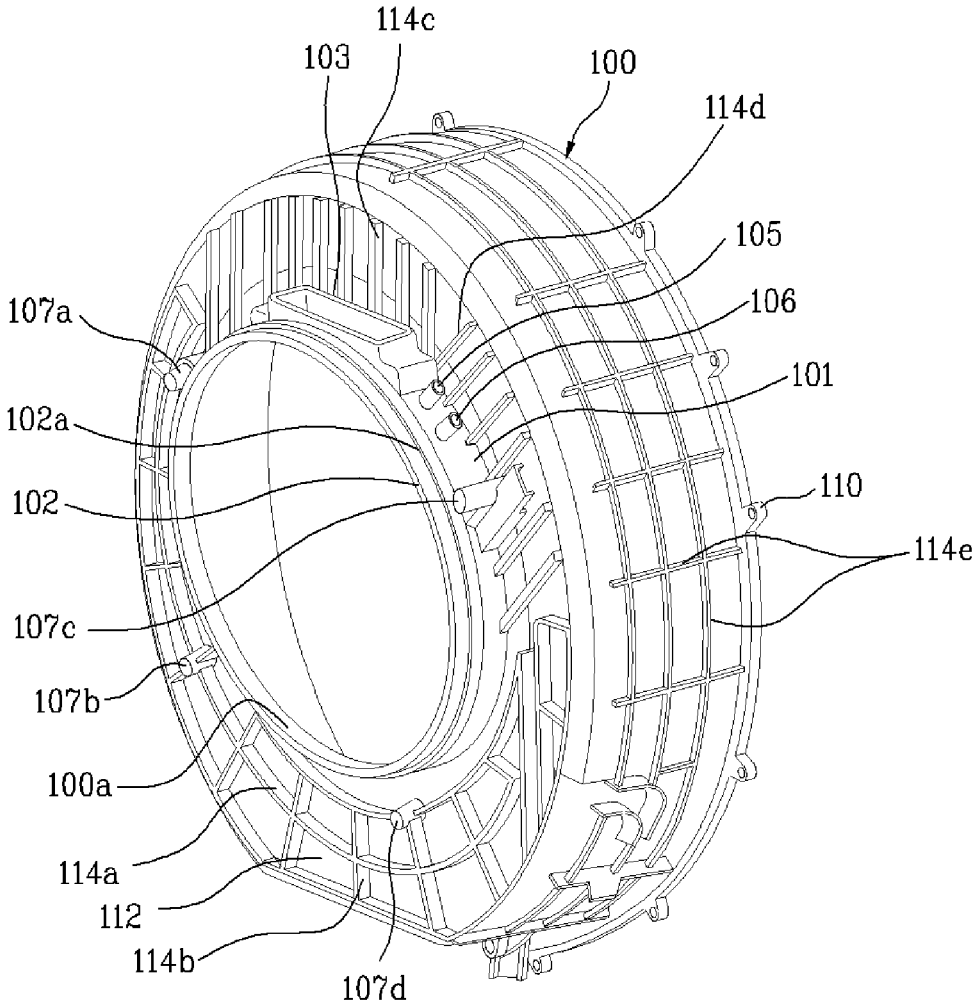
FIGS. 2 and 3 illustrate perspective views of tub fronts of a laundry machine in accordance with a preferred embodiment of the present invention, respectively.
Figure 3:
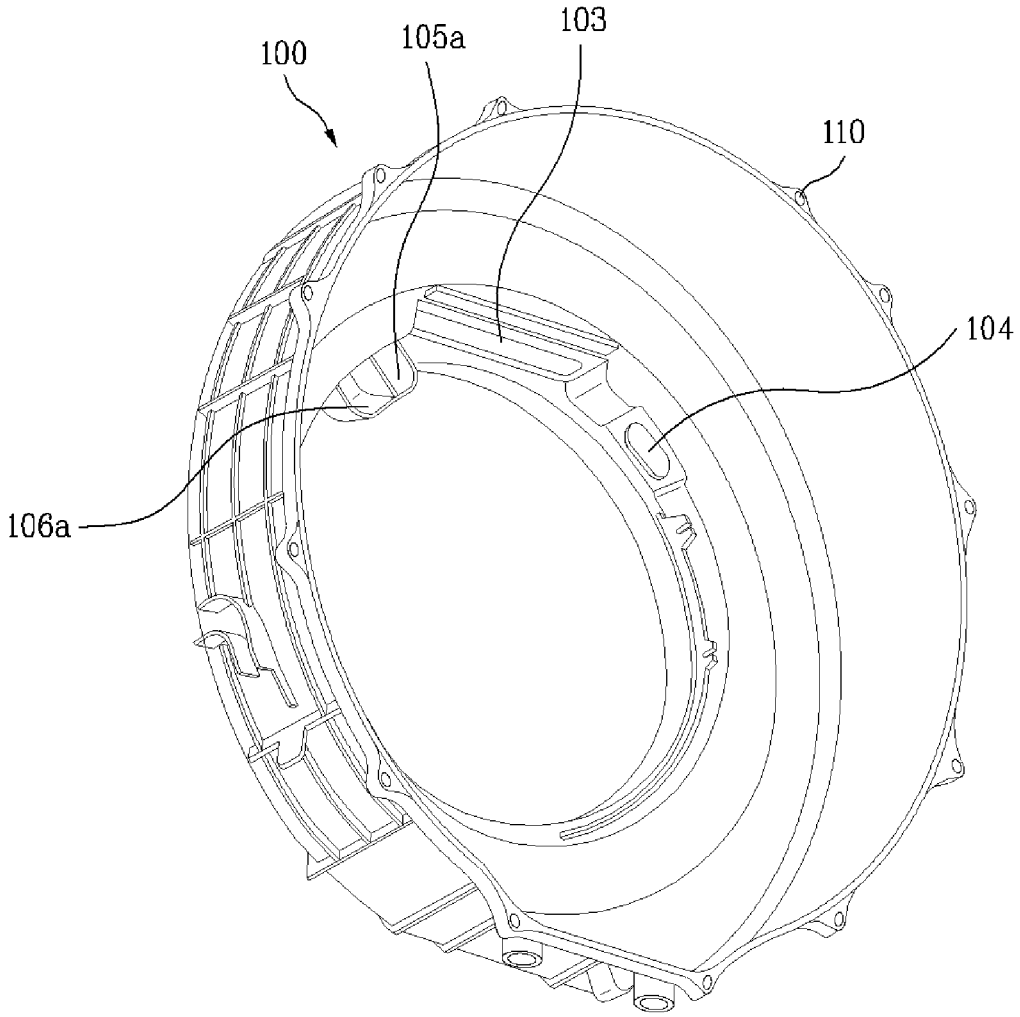

FIGS. 2 and 3 disclose the tub front 100. The tub front 100 has a donut shaped vertical front surface at a front side of a cylindrical surface which is a portion of a sidewall of the tub 10. The front surface has a laundry opening 100*a* for introduction of the laundry. A rear side of the cylindrical surface is opened the same as an opening of the cylinder of the tub front 100, and has a plurality of fastening holes 110. The fastening holes 110 are fastened to fastening holes 127 (See FIG. 4) in the tub rear 120 matched thereto, respectively.

A rim portion 101 is extended forward from an inside circumferential surface of a front surface 112 of the tub front 100. The rim portion 101 has a width which becomes the smaller as the rim portion 101 goes from an upper side to a lower side the more. There may not be the rim portion 101 formed on a lower side of an inner edge of the front surface 112, actually.

The rim portion 101 has a water supply inlet 104, a hot air inlet 103 to be used for drying, a circulating water inlet 106 for inlet of washing water circulated by a circulating pump, and a steam inlet 105 for introduction of steam.

Since the laundry machine of the present invention has vibration of the tub 10 reduced significantly, connections of a water supply structure, such as the water supply hose for supplying washing water, a structure for drying, such as drying duct, a structure for supplying steam, a structure for supplying the circulating water, and so on can be held in position, securely.

The hot air inlet 103 is an upward rectangular shaped extension from the rim portion 101, substantially. The hot air inlet 103 is required for a washing and drying machine, and may not be required for a washing machine which has no drying function.

Since the water supply inlet 104, the hot air inlet 103 and so on are formed in the front portion of the tub front 100, supply of the washing water, the hot air and so on are made at the front side of the tub 10.

The water supply inlet 104 and so on can be positioned in front of a front end of the drum 30 which is housed in the tub 10. Accordingly, the washing water, the hot air and so on can be introduced to the drum 30 directly through the laundry opening provided for laundry in/out. Since fluids which are supplied for treating the laundry, such as the washing water, the hot air and so on, can be introduced to the drum 30 directly, effective treatment of the laundry is possible.

Moreover, in a case detergent is supplied together with the washing water which is supplied through detergent box, if the detergent is introduced to the drum 30 directly, consumption of the detergent can be reduced, enabling to reduce an amount of the washing water, accordingly.

And, a problem of contamination of a bottom of the tub 10 by deposition of detergent sediments can be reduced. Furthermore, the water supply from the front of the tub 10 can have an effect of washing door glass (not shown).

Even if the hot air is supplied from the front of the tub 10, if the hot air is supplied through a vertical surface of the tub front 100, since a flow of the hot air undergoes two times of bending to form a '⊂'-shape (a '⊂'-shaped complicate flow is formed as the hot air introduced into the tub 10 is bent downward at a front of the tub 10 and bent forward of the tub 10 again), the flow of the hot air can be poor. However, if the hot air inlet 103 is formed in the rim portion 101 of the tub front 100, the flow of the hot air can be smooth since the hot air flow is required to bend only once, vertically.

The water supply inlets 104 and so on are positioned above a center point of the drum. The washing water and so on are supplied to the drum 30 from an upper side of the front of the drum. If, different from this, if it is required to supply the washing water and so on to the drum 30 from a lower side of the front of the drum, the rim portion 101 of the tub front 100 may be formed at the lower side of the front surface 112, accordingly. If it is required to supply the washing water and so on to the drum, not from the upper or lower side, but from a left or right side of the drum, the rim portion 101 can be formed in the vicinity of a center portion of an inside edge of the front surface 112, accordingly. That is, a shape of the rim portion 101 can vary with a direction of supply of the fluids.

In a front edge of the rim portion 101, there is a coupling portion 102 for coupling the foreign matter getting in preventive member 200 thereto. The coupling portion 102 is a forward extension from a front end of the rim portion 101 to form a small cylindrical surface, substantially. The small cylindrical surface has a coupling rib 102*a* formed on an outside circumferential surface of the small cylindrical surface.

In the meantime, the front surface 112 and the cylindrical surface have a plurality of reinforcing ribs formed thereon for reinforcing strength of the tub front 100. At the time of fabrication of the tub front 100, shapes of the reinforcing ribs can vary with a sliding drawing out direction of a slide core of a mold by using which the tub front 100 is fabricated.

At first, a plurality of reinforcing ribs are formed on the front of the front surface 112 for reinforcing strength of the front surface 112. The reinforcing ribs on the front surface 112 has radial reinforcing ribs 114*b* formed in a radial direction centered on the center of the front surface 112, and circular reinforcing ribs 114*a* formed in shapes of donuts along a donut shape of the front surface 112.

In this instance, the radial reinforcing ribs 114*b* and the circular reinforcing ribs 114*a* are formed to cross each other at the front surface 112, respectively. Accordingly, the metal core for forming the radial reinforcing ribs 114*b* and the circular reinforcing ribs 114*a* forms the radial reinforcing ribs 114*b* and the circular reinforcing ribs 114*a* as the metal core slides perpendicular to the front surface 112.

In this instance, the metal core sliding thus can form other parts, additionally. For an example, the rim portion 101 perpendicular to the front surface 112, the fastening bosses 107*a*, 107*b*, 107*c* and 107*d* and so on can be formed at the same time with the radial reinforcing ribs 114*b* and the circular reinforcing ribs 114*a*.

In the meantime, the rim portion 101 has the water supply inlet 104, the hot air inlet 103, the circulating water inlet 106, the steam inlet 105 formed on an outside circumference thereof. Such parts are formed at different angles with reference to a center of the rim portion 101.

Therefore, in order to form the water supply inlet 104, the hot air inlet 103, the circulating water inlet 106, the steam inlet 105 and so on, a plurality of slide core molds are required. And, the reinforcing ribs adjacent to the water supply inlet 104, the hot air inlet 103, the circulating water inlet 106, the steam inlet 105 and so on are formed parallel to a moving direction of the slide mold which forms the water supply inlet 104, the hot air inlet 103, the circulating water inlet 106, the steam inlet 105 and so on.

For an example, the water supply inlet 104, and the hot air inlet 103 are formed by a slide mold which moves upward perpendicular to the front surface. The water supply inlet 104 is a hole having a fitting member coupled thereto, and the hot air inlet 103 is a projection having an additional fitting member is coupled thereto. The reinforcing ribs formed on the front surface 112 adjacent to the water supply inlet 104, and the hot air inlet 103 at the time of formation of the water supply inlet 104, and the hot air inlet 103 are vertical ribs 114*c* formed along moving path of the slide mold core.

In the meantime, the circulating water inlet 106, and the steam inlet 105 are projections having tube members coupled thereto additionally, respectively. In order to form the circulating water inlet 106, and the steam inlet 105, a slide core according to a direction of formation of the circulating water inlet 106, and the steam inlet 105 is required. At the time of formation of the circulating water inlet 106, and the steam inlet 105, the reinforcing ribs formed on the front surface 112 adjacent to the circulating water inlet 106, and the steam inlet 105 are tilted ribs 114*b* formed along a moving direction of the slide mold used in formation of the circulating water inlet 106, and the steam inlet 105.

In addition to this, the tub front 100 may have tub front outside circumference reinforcing ribs 114*e* formed on an outside circumferential surface of the tub front 100 for reinforcing the outside circumferential surface of the tub front 100. The tub front outside circumference reinforcing ribs 114*e* are also formed along a moving direction of the mold used when the tub front 100 is formed.

The foreign matter getting in preventive member 200 is coupled to the coupling portion 102 as the coupling portion 102 is placed in the foreign matter getting in preventive member 200. Accordingly, the foreign matter getting in preventive member 200 has a groove (not shown) for placing the small cylindrical surface having the coupling rib 102*a* formed therein.

The tub front 100 is fixedly connected to the cabinet front (not shown). For this fixed connection of the tub front 100, fastening bosses 107*a*, 107*b*, 107*c* and 107*d* are formed on the front surface of the tub front 100 around the rim portion 101, substantially. After positioning the cabinet front (not shown) in a state the tub front 100 is mounted, the cabinet front (not shown) is fastened to the tub front 100 by fastening screws in a rear direction.

FIG. 3 illustrates a perspective view of the tub front 100 seen from a back side thereof. The steam inlet 105 can be connected to a steam hose. The steam inlet 105 has a steam guide 105*a* for guiding the steam introduced thereto to an inside of the drum. The circulating water inlet 106 has a circulating water guide 106*a* for guiding the circulating water introduced to the circulating water inlet 106 to the inside of the drum. The steam inlet 105, the circulating water inlet 106, the steam guide 105*a* and the circulating water guide 106*a* are formed as one unit with the tub front 100. The tub front 100 of plastic is injection molded together with the steam inlet 105 and so on as portions of the tub front 100.

The tub front 100 is coupled to the tub rear 120 to form a space for housing the drum 30. The tub front 100 and the tub rear 120 are fastened with screws. For this screw fastening, the tub front 100 has a plurality of screw fastening holes 110 formed along a circumference of a rear portion thereof.

Figure 4:
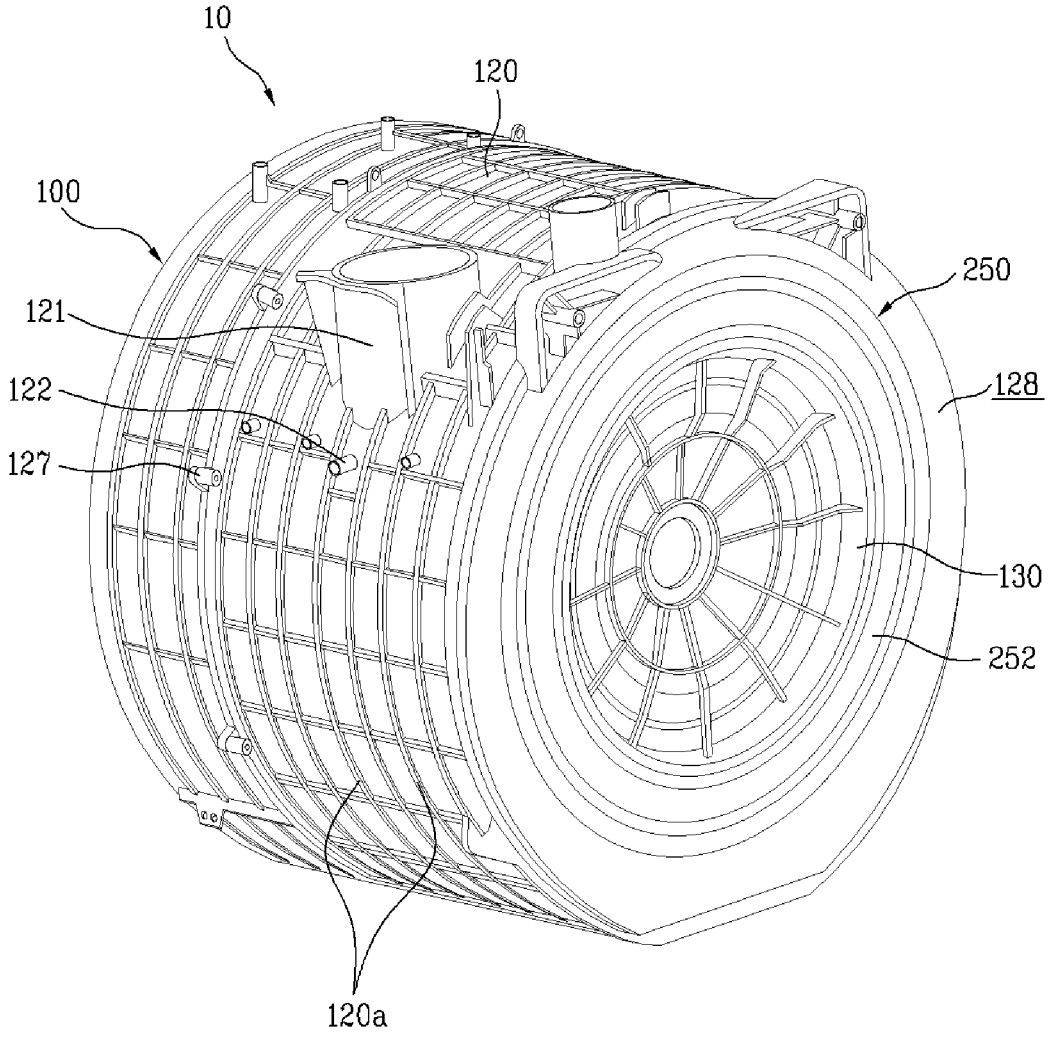
FIG. 4 illustrates a rear perspective view of a tub rear of a laundry machine in accordance with a preferred embodiment of the present invention.

FIG. 4 illustrates the tub front 100, the tub rear 120, the tub back 130, and the rear gasket 250 assembled together.

The tub rear 120 is cylindrical to surround the drum 30, and has an opened front opened as it is, and a donut shaped rear surface 128. The front is sealably coupled to the tub front 100. The rear surface of the tub rear 120 has a diameter adequately greater than the outside diameter of the tub back 130, so that a gap is formed enough to prevent the tub back 130 from interfering with the rear surface of the tub rear 120 even if the tub back 130 vibrates.

And, between the rear surface of the tub rear 120 and the tub back 130, there is the rear gasket 250 connected thereto. The rear gasket 250 seals between the rear surface of the tub rear 120 and the tub back 130. The rear gasket 250 has a corrugated portion 252 having an adequate flexibility for not interfering with the vibration of the tub back 130.

The tub rear 120 has a hot air outlet 121 on one side for the washing and drying machine. It is natural that the hot air outlet 121 is not required if the laundry machine is not the washing and drying machine, but a washing machine only for washing.

Moreover, the tub rear 120 may have a plurality of tub rear outside circumference reinforcing ribs 120*a* formed on an outside circumferential surface of the tub rear 120 for reinforcing strength of the outside circumferential surface of the tub front 100. The tub rear outside circumference reinforcing ribs 120*a* are also formed along a moving direction of a mold core at the time of formation of the tub rear 120.

In this instance, the tub rear outside circumference reinforcing ribs 120*a* on the outside circumference of the tub rear 120 have heights lower than the tub front outside circumference reinforcing ribs 114*a* on the tub front 100 or a number smaller than the tub front outside circumference reinforcing ribs 114*a* on the tub front 100. Since the laundry machine of the present invention is in a state in which the tub front 100 is fixed to the cabinet front (not shown), a greatest load is on the tub front 100. Therefore, strength of the tub rear 120 needs not be greater than the tub front 100. If the strength of the tub rear 120 can be assured adequately, no reinforcing ribs may be formed on the tub rear 120.

In the meantime, on undersides of the tub front 100 and the tub rear 120, there are additional structures for securing and supporting the tub 10 on the base.

Figure 6:
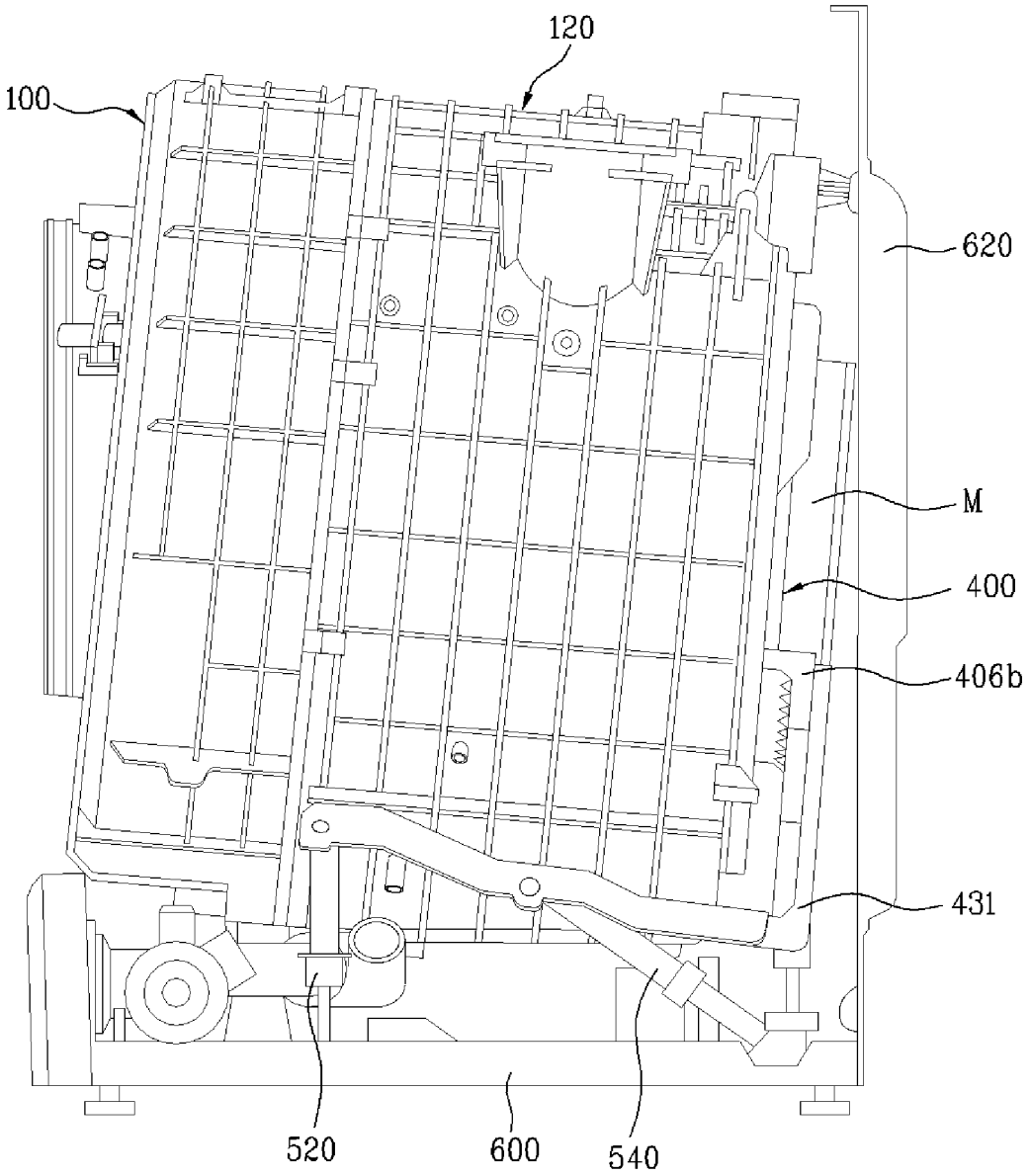
FIG. 6 illustrates a side view of an assembly of a tub and a suspension assembly of a laundry machine in accordance with a preferred embodiment of the present invention.

FIG. 5 illustrates a perspective view showing a suspension assembly 40 mounted on the base 600. FIG. 6 illustrates a side view of an assembly of the tub 100 and 120, the bearing housing 400, and the suspension assembly 40.

The bearing housing 400 includes a bearing supporting portion 401 for supporting the bearings. On a front side of the bearing housing 400, there is a tub back fastening portion 407 formed thereon. On a rear side of the bearing housing 400, there is a stator fastening portion 402 formed thereon.

In this instance, the suspension assembly 40 includes the bearing housing 400, a first tilted bracket 431 and a second tilted bracket 430, and a first suspension bracket 450 and a second suspension bracket 440.

There are a first extension 406*a* and a second extension 406*b* which are extensions from the bearing housing 400 in a radial direction to left and right sides thereof. The first extension 406*a* and the second extension 406*b* have a first tilted bracket 431 and a second tilted bracket 430 connected thereto, respectively. The first tilted bracket 431 and the second tilted bracket 430 have the first suspension bracket 450 and the second bracket 440 connected thereto, respectively.

In this instance, the first extension 406*a*, the first tilted bracket 431, the first suspension bracket 450 and the second extension 440, the second tilted bracket 430, the second suspension bracket 440 are symmetry. In this instance, the first, and second tilted brackets 431 and 430 serves to balance a center of gravity of the drum when laundry is introduced to the drum, and as mass in a vibration system in which the drum 30 vibrates.

The suspension assembly 40 may include a first spring cylinder damper 520, a second spring cylinder damper 510, a third spring cylinder damper 500 which are arranged in a vertical direction for vertical direction buffering, and a first cylinder damper 540 and a second cylinder damper 530 arranged in a tilted position for front/rear direction buffering.

In this instance, of the first spring cylinder damper 520, the second spring cylinder damper 510 and the third spring cylinder damper 500, one may be arranged on a rear side and two may be arranged on left/right sides on a front side of a center of the base 600. And, the first cylinder damper 540 and the second cylinder damper 530 may be arranged in a front/rear direction on left/right sides with reference to the center in a tilted position.

In detail, the first cylinder damper 540 is connected between the first suspension bracket 450 and the base 600. The second spring cylinder damper 510 is connected between the second suspension bracket 440 and the base 600. The third spring cylinder damper 500 is connected between the bearing housing 400 and the base 600.

The first cylinder damper 540 is arranged between the first suspension bracket 450 and a rear side of the base in a tilted position, and the second cylinder damper 530 is arranged between the second suspension bracket 440 and the rear side of the base in a tilted position.

That is, the third spring cylinder damper 500 is arranged at a center of a rear side, and the first cylinder damper 540 and the second spring cylinder damper 510 are arranged on left/right sides of a front side. The first cylinder damper 540 and the second spring cylinder damper 510 are positioned on opposite sides of the third spring cylinder damper 500. That is, the spring dampers 500, 510 and 520 are arranged symmetry with the cylinder dampers 530 and 540 in left/right directions.

In the meantime, since the laundry machine of the present invention allows the tub 10 (for convenience s sake, the tub front and the tub rear will be called as the tub, collectively) and the drum 30 to make vibrate independently owing to individual supporting structures. Therefore, in order to prevent an outside circumferential surface of the drum 30 from hitting an inside circumferential surface of the tub 10 when the drum 30 vibrates, a new structure is required.

Figure 7:
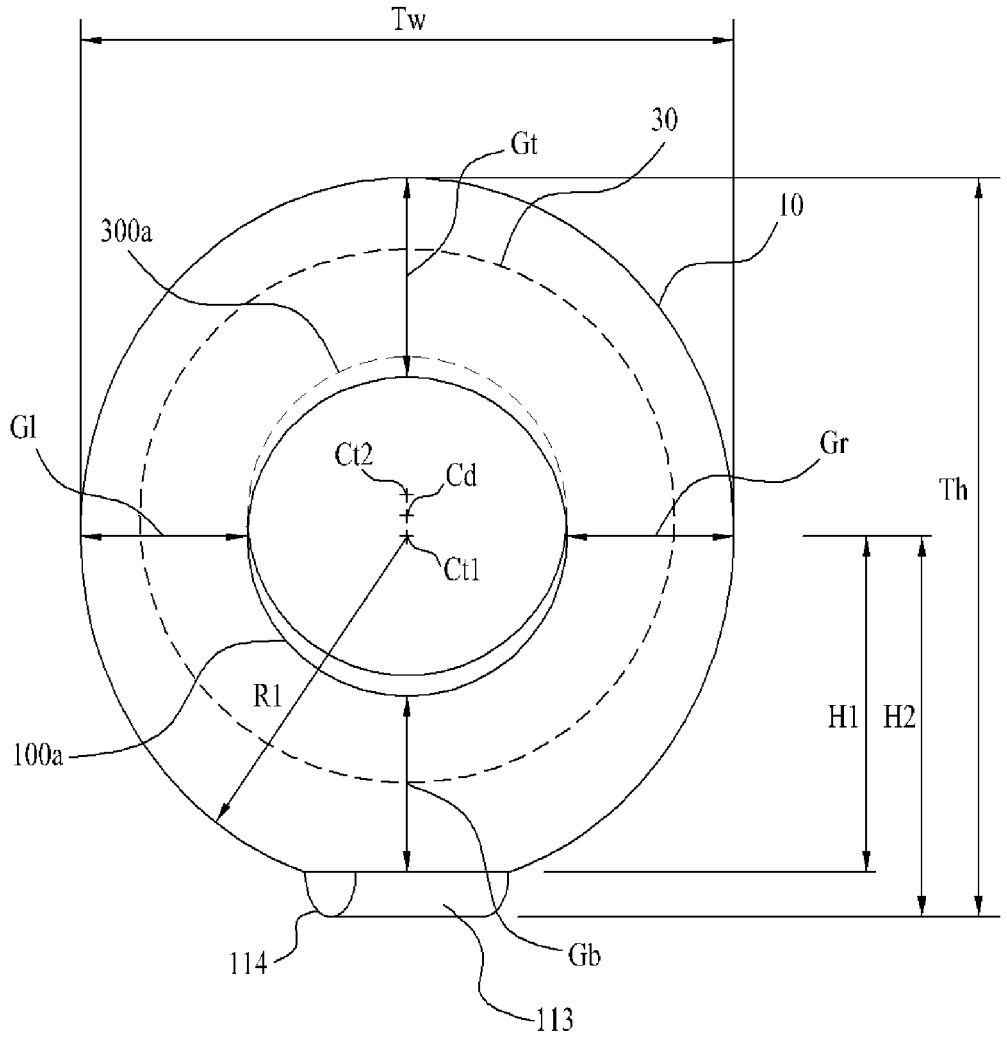
FIG. 7 illustrates a front view of a tub of a laundry machine in accordance with a preferred embodiment of the present invention, schematically.

A shape of the tub for preventing the drum 30 which vibrates from hitting the tub 10 which is stationary will be described. FIG. 7 illustrates a front view of a tub of a laundry machine in accordance with a preferred embodiment of the present invention, showing a front of the tub schematically.

The tub 10 of the present invention may have a cylindrical shape for holding washing water therein. However, though the tub is cylindrical substantially, the tub 10 may be provided to have a cross section thereof is an ellipse or a shape having more than one central axes.

It is preferable that the tub 10 has a front side shape with two cylinders with two centers Ct1 and Ct2 thereof overlapped with each other. This is because the tub 10 of the present invention is stationary, and the drum 30 can sag downward regardless of a position of the tub due to the laundry introduced to the drum 30.

The front side shape of the tub 10 is also favorable for preventing interference with up/down direction vibration of the drum. Since it is liable that the drum 30 has the up/down direction vibration greater than the left/right direction vibration, it is favorable for avoiding the interference that the drum 30 is formed to have a greater up/down direction length than a left/right direction length.

That is, making an up/down direction height Th greater than a left/right direction width Tw of the front side of the tub is favorable for avoiding the interference. Particularly, the greater the up/down direction vibration of the front of the drum 30, it may be more favorable that the up/down direction height Th is made greater than the left/right direction width Tw of the front side of the tub.

For the shape, the front side of the tub 10 may be formed to have a shape with two cylinders connected to each other, with two centers Ct1 and Ct2 thereof spaced from each other, or an eclipse.

In the meantime, the tub has a laundry opening 100*a* in the front thereof. It is preferable that the laundry opening 100*a* has a center Ct2 formed on an upper side of a center Cd of the front of the tub 10. Actually, no sagging takes place at the front of the drum 30 if no laundry is introduced to the drum 30. Accordingly, in order to align the laundry opening 100*a* in the drum 30 with the laundry opening 100*a* in the tub 10, the center Ct2 of the laundry opening 100*a* of the tub 10 is made to position on an upper side of the center Cd of the front of the tub 10.

In this case, distances between an outside circumferential surface of the front side of the tub 10 and an inside circumferential surface of the laundry opening 100*a* will be reviewed. At first, a distance Gt between a top of the laundry opening 100*a* of the tub 10 and a top of the front of the tub 10 is formed to be shorter than a distance Gb between a bottom of the laundry opening 100*a* of the tub 10 and a bottom of the front of the tub 10.

And, a distance GI between a left side of the laundry opening 100*a* of the tub 10 and a left side of the front of the tub 10 is formed to be the same with a distance Gr between a right side of the laundry opening 100*a* of the tub 10 and a right side of the front of the tub 10.

And, a sum of the distance Gt between the top of the laundry opening 100*a* of the tub 10 and the top of the front of the tub 10 and the distance Gb between the bottom of the laundry opening 100*a* of the tub 10 and the bottom of the front of the tub 10 is formed greater than a sum of the distance GI between the left side of the laundry opening 100*a* of the tub 10 and the left side of the front of the tub 10 and the distance Gr between the right side of the laundry opening 100*a* of the tub 10 and the right side of the front of the tub 10. In general, a sump space 113 may be formed under the tub 10 for draining the washing water from the tub 10. Such a sump space 113 is formed enlarged under the tub 10.

In order to form the sump space 113, a horizontal cut portion 114 is formed. The horizontal cut portion 114 is spaced by a predetermined distance H1 between the center Cd of the tub 10 to the bottom of the tub 10. A distance H2 between the center Cd of the tub 10 to the bottom of the sump space 113 is greater than the distance H1 between the center Cd of the tub 10 to the bottom of the tub 10.

In this instance, it is preferable that the distance H1 between the center Cd of the tub 10 to the bottom of the tub 10 is smaller than a radius R1 of a lower portion of the tub 10, and the distance H2 between the center Cd of the tub 10 to the bottom of the sump space 113 is greater than the radius R1 of the lower portion of the tub 10.

In the meantime, though not shown, the rear surface 128 (See FIG. 4) of the tub rear 120 may have a structure the same with the front of the tub 10 described above.

That is, the tub rear 120 has the opening for mounting the rear gasket 250 thereto. The opening in the tub rear 120 fixes distances of an upper portion, a lower portion, a left portion, and a right portion of the rear surface of the tub rear 120.

In this instance, the upper portion distance of the tub rear 120 is smaller than the lower portion distance of the tub rear 120, and the left portion distance of the tub rear 120 is the same with the right portion distance of the tub rear 120. And, the sum of distances of the upper portion and the lower portion of the tub rear 120 is greater than a sum of the distances of the left portion and the right portion of the tub rear 120.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry machine, comprising:

a tub to receive wash water;

a drum rotatably provided in the tub;

drive including a shaft connected to the drum, a bearing housing to rotatably support the shaft, and a motor to rotate the shaft; and a suspension to reduce vibration of the drum, wherein an up/down direction height of a front of the tub is greater than a left/right direction width of the tub, and wherein the tub has a front surface having a rim that projects from the front surface to form a laundry opening, wherein the rim includes a plurality of projections, and wherein portions of the front surface at a rear of the plurality of projections include a plurality of ribs that extend in a same direction as a projection direction of the plurality of projections.

2. The laundry machine as claimed in claim 1, wherein the front of the tub has a cross section formed by overlapping two circles in a vertical direction to form an ellipse, the two circles respectively having two centers spaced in a vertical direction.

3. The laundry machine as claimed in claim 1, wherein the front of the tub has a horizontal cut portion at a bottom of the tub, and further includes an enlarged space that extends outward from the horizontal cut portion.

4. The laundry machine as claimed in claim 3, wherein the horizontal cut portion extends from the front surface of the tub toward a rear side of the tub by a predetermined distance.

5. The laundry machine as claimed in claim 3, wherein a distance from a center of the front of the tub to a center of a bottom of the front of the tub is shorter than a distance from the center of the front of the tub to a center of a bottom of the enlarged space of the tub.

6. The laundry machine as claimed in claim 1, wherein the laundry opening has a center spaced from the center of the front of the tub.

7. The laundry machine as claimed in claim 6, wherein the center of the laundry opening is positioned over the center of the front of the tub.

8. The laundry machine as claimed in claim 6, wherein an upper portion of the front of the tub above the laundry opening has a width smaller than a width of a lower portion of the front of the tub below the laundry opening.

9. The laundry machine as claimed in claim 6, wherein a sum of widths of upper and lower portions of the front of the tub respectively above and below the laundry opening is greater than a sum of widths of left and right portions of the front of the tub respectively at left and right sides of the laundry opening.

10. The laundry machine as claimed in claim 1, wherein a distance from a center of the front of the tub to a center of a bottom of the front of the tub is shorter than a distance from the center of the front of the tub to a side of the bottom of the tub.

11. The laundry machine as claimed in claim 1, wherein the suspension is connected to the bearing housing.

12. The laundry machine as claimed in claim 1, further including a rear gasket to prevent water from leaking between the drive and the tub, and allow the drive to move relative to the tub.

13. The laundry machine as claimed in claim 12, wherein the tub has a rear surface formed on a rear side and having an opening having the rear gasket fastened thereto.

14. The laundry machine as claimed in claim 13, wherein a width of an upper portion of the rear surface above the opening is smaller than a width of a lower portion thereof below the opening.

15. The laundry machine as claimed in claim 13, wherein a sum of widths of upper and lower portions of the rear surface respectively above and below the opening is greater than a sum of widths of left and right portions of the rear surface respectively at left and right sides of the opening.

16. The laundry machine as claimed in claim 1, wherein the tub is supported more rigidly tan the drum is supported by the suspension.

17. The laundry machine as claimed in claim 1, wherein the front surface has a plurality of radial ribs formed on at least one portion other than the portions of the front surface at the rear of the plurality of projections.

18. The laundry machine as claimed in claim 17, wherein a distance between the plurality of radial ribs on the at least one portion is greater than a distance between the plurality of ribs at the portions of the front surface at the rear of the plurality of projections.

19. The laundry machine as claimed in claim 18, wherein the at least one portion further includes a plurality of circumferential direction ribs formed thereon.

20. The laundry machine as claimed in claim 1, wherein the plurality of projections at the rim is at least one of a water supply inlet, a hot air inlet, a circulating water supply inlet, or a steam supply inlet.

21. The laundry machine as claimed in claim 20, wherein the plurality of projections at the rim is at least one of a water supply inlet, a hot air inlet, a circulating water supply inlet, or a steam supply inlet.

22. A laundry machine, comprising:

a tub to receive wash water;

a drum rotatably provided in the tub;

a drive including a shaft connected to the drum, a bearing housing to rotatably support the shaft, and a motor to rotate the shaft; and a suspension assembly that supportably buffers vibration of the drum, wherein the tub has a front surface that forms a front of the tub, wherein the front surface includes a rim that projects from the front surface, wherein the rim includes a plurality of projections, and portions of the front surface at a rear of the plurality of projections have a plurality of ribs formed in a same direction as a projection direction of the plurality of projections, and wherein the front surface includes a plurality of radial ribs formed on at least one portion other than the portions of the front surface at the rear of the plurality of projections.

23. The laundry machine as claimed in claim 22, wherein distances between the plurality of radial ribs are each greater than each of distances between the plurality of ribs at the portions of the front surface at the rear of the plurality of projections.

24. The laundry machine as claimed in claim 23, wherein the portion having the plurality of radial ribs formed thereon further includes a plurality of circumferential direction ribs formed thereon.

* * * * *